US005787144A

United States Patent [19]

Findlay

[11] Patent Number: 5,787,144

[45] Date of Patent: Jul. 28, 1998

[54] STERILIZATION PROCESS FOR MEDICAL DEVICES

[75] Inventor: Mark J. Findlay, San Angelo, Tex.

[73] Assignee: Ethicon, Inc., Somerville, N.J.

[21] Appl. No.: 748,874

[22] Filed: Nov. 14, 1996

[51] Int. Cl.[6] ..... G21K 5/10

[52] U.S. Cl. ..... 378/69; 378/64; 250/436; 250/437; 250/438; 250/482.1; 250/453.11; 250/454.11; 426/240

[58] Field of Search ..... 378/69, 64; 426/240; 250/453.11, 454.11, 436, 437, 438, 482.1; 99/451

[56] References Cited

U.S. PATENT DOCUMENTS 3,225,203 12/1965 Gombert ..... 250/106
3,496,362 2/1970 Kirkpatrick et al. .
4,066,907 1/1978 Tetzlaff .
4,481,652 11/1984 Ransohoff .
5,008,550 4/1991 Barrett .
5,400,382 3/1995 Welt et al. .

*Primary Examiner*—Laurie Scheiner
*Attorney, Agent, or Firm*—Emil Richard Skula

[57] ABSTRACT

A radiation sterilization process for medical devices. The position of a $CO_{60}$ source is monitored during a sterilization process. If the $CO_{60}$ source moves out of the irradiation position, the central control unit moves the source down into a containment pool and stops the cycle timers. The source is then moved back up to the irradiation position and the cycle is restarted and the timers are restarted. The cycle time may be corrected using an algorithm.

3 Claims, 4 Drawing Sheets

STERILIZATION PROCESS FOR MEDICAL DEVICES

TECHNICAL FIELD

The field of art to which this invention relates is sterilization processes, in particular, radiation sterilization processes for medical devices such as surgical needles and surgical sutures.

BACKGROUND OF THE INVENTION

It is well known in the medical field that medical devices, including devices such as surgical needles and sutures, must be sterilized prior to use in a surgical procedure in order to reduce the incidence of infection in patients. Surgical needles and sutures are typically manufactured in accordance with strict quality control requirements to reduce bioburden, and packaged in specially designed packages having bio-barriers. In addition, sterilization processes have been developed which consistently and reproducibly sterilize surgical needles and sutures in such packages. These sterilization processes include conventional autoclaving processes wherein the packaged needles and sutures are exposed to elevated temperatures and humidity. Another conventionally used sterilization process is ethylene oxide sterilization wherein the packaged needles and sutures are exposed to moisture, ethylene oxide gas and elevated temperature. Yet another conventional method of sterilizing packaged surgical sutures and needles, as well as various medical devices, is radiation sterilization. In this type of sterilization, the medical devices are exposed to ionizing radiation (i.e., gamma radiation) emitted by a radioactive source, typically cobalt ($Co_{60}$). The dosage is calculated in a radiation sterilization process to provide sterile product.

Depending upon the type of medical device and its materials of construction, one or more of the previously-described sterilization processes may be utilized. It is preferable to use radiation sterilization for medical devices which may be sensitive to heat or moisture, e.g., devices made from certain polymers such as nylon, polyesters, polypropylene and the like, as well as devices made from biodegradable or bioabsorbable materials such as polyglcolide, polylactide, polydioxanone, polycaprolactone and the like.

In a conventional cobalt radiation sterilization process, a radioactive source is submerged and stored in a conventional pool of water referred to as a containment pool. When submerged in the storage position, the radiation emitted by the source is contained within the pool. The source and the pool are additionally housed in a conventional radiation containment structure. The source is typically mounted to a conventional mechanical hoist or elevator which raises the source up and out of the water to a predetermined irradiation position, and also lowers the source back into the water of the containment pool. The medical devices which are processed for sterilization are typically placed in carriers which are mounted to a conveyor system. The conveyor system is mounted about the interior of the containment structure and typically is constructed to form a path about the radioactive source so that each medical device in each carrier sees the same radiation dose. The conveyor also extends out of, and is redirected to move back into, the containment structure in a continuous loop manner to facilitate loading and unloading of medical devices.

A typical batch sterilization cycle commences when the source is raised and locked into a fixed irradiation position. The conveyor is then energized and caused to move along the pathway about the source. The speed (or time between indexes) of the conveyor, the spatial layout of the pathway, and the configuration of the carriers are precisely controlled to provide an exact dose of radiation to each medical device during each sterilization cycle. At the end of a cycle, the cobalt source is lowered into the containment tank, unless products of similar density and required dosage are queued behind the treated product The process may also be run on a continuous basis for products of similar density and required dosage.

It is known that the control of radiation dosage is critical during a radiation sterilization cycle. A medical device that receives a "high" dose may be damaged. A medical device that receives a low dose may not be sterile. Accordingly, conventional radiation sterilization processes typically have conventional precise timing controls to assure that the required radiation dose is delivered. The timing controls are often referred to in this art as cluster timers. The controls also prevent overdosing or underdosing. The radiation sterilizers and sterilization processes are typically controlled by conventional central control units known in this art.

Since a radiation sterilizer contains an inherently dangerous radioactive source, numerous and redundant safeguards and controls are built into the sterilization unit and the process controller. Examples of such safeguards include heat detectors, smoke detectors, jammed mechanism sensors, product exit radiation monitors, earthquake detectors, exhaust fan sensors, rigorous start-up sequences and incorrect access sensors. One particular conventional safeguard involves the position of the $Co_{60}$ source. In particular, the $Co_{60}$ source when it is raised out of the containment pool is locked into place in a fixed, raised position typically referred to as the irradiation position. On occasion, the elevator mechanism which raises and lowers the source may cause the source to displace slightly. Should this event occur, it will be sensed by a position switch, and a conventional central control unit operating the sterilizer will shut down the cycle timers. This "shutdown" has the effect of disrupting the dosage of radiation to the sterilizer load since radiation is still being delivered to the sterilizer load even though the timer is off. When this type of event is experienced, conventional radiation sterilization units have no automatic way of preventing radiation over- or underdosage when the timer is off.

There is a need in this art for an improved sterilization process which automatically prevents under- or over-dosage of radiation when an event occurs during a sterilization cycle wherein a source moves from an irradiation position and causes the cycle timer to be stopped.

DISCLOSURE OF THE INVENTION

Therefore, it is an object of the present invention to provide an improved cobalt sterilization process which provides for a consistent delivery of radiation dosage when a source inadvertently moves from an irradiation position during a sterilization cycle.

It is yet a further object of the present invention to provide an improved cobalt sterilization process which allows for the precise adjustment of sterilization cycle times when a source inadvertently moves from an irradiation position.

Accordingly, an improved radiation sterilization process is disclosed. The process consists of moving at least one medical device about a $Co_{60}$ radiation source to provide a sufficient dose of radiation to effectively sterilize the medical device. The source position is constantly monitored to determine whether it is in the irradiation position. If the source moves from the irradiation position the cycle timer is stopped. The improvement consists of immediately moving the source to the storage position when detecting source movement. Then the sources is raised to the irradiation position and the cycle timer is re-started at the next startup. This prevents product from being overdosed with a raised source that is not in the irradiation position, but is still emitting and delivering radiation while the cycle timer is stopped.

Yet another aspect of the present invention is an improved radiation sterilization process which provides for the correction of cycle time when a source is raised and lowered in response to an untoward event causing a shutdown, such as source movement from the irradiation position. The process consists of moving at least one medical device about a $Co_{60}$ radiation source to provide a sufficient dose of radiation to effectively sterilize the medical device. The source position is constantly monitored to determine whether it is in the irradiation position. If the source inadvertently moves from the irradiation position to a second position, the cycle timer is stopped. The improvement consists of immediately lowering the source into the storage position if movement of the source is detected, correcting the cycle time by use of a correction factor, then raising the source into the irradiation position and re-starting the timer. The times are measured during this raising and lowering sequence and the cycle time is adjusted using the following algorithm: Correction Value= Td+(Tmd+Tmu)/2. In this algorithm, Td is the measured pause time between the detection of movement from the irradiation position to a second raised position and the start of movement of the source down; Tmd is the travel time of the top of the source from the second raised position to the top of the pool; and, Tmu is the time of the travel up from the pool to the irradiation position. The correction value is subtracted from the cycle time when the source is in the down position in the containment pool. The use of this correction factor assures that each medical device receives the proper dose of radiation when untoward movement of the source requires that the source be lowered to the storage position and then raised to the irradiate position.

These and other benefits and advantages of the present invention will become more apparent from the following discussion and accompanying drawings.

DESCRIPTION OF PREFERRED EMBODIMENTS

Conventional cobalt sterilization processes and equipment are described in the publications *Sterilization of Medical Products*, Volumes II, IV and V, Polyscience Publications, Inc., Morin Heights, Canada, and *Sterilization Technology, a practical Guide for Manufacturers and Users of Health Care Products*, Morrissey, R. F. and Philips, G. B., Van Nostrand Reinhold, N.Y. (1993).

Figure 1:
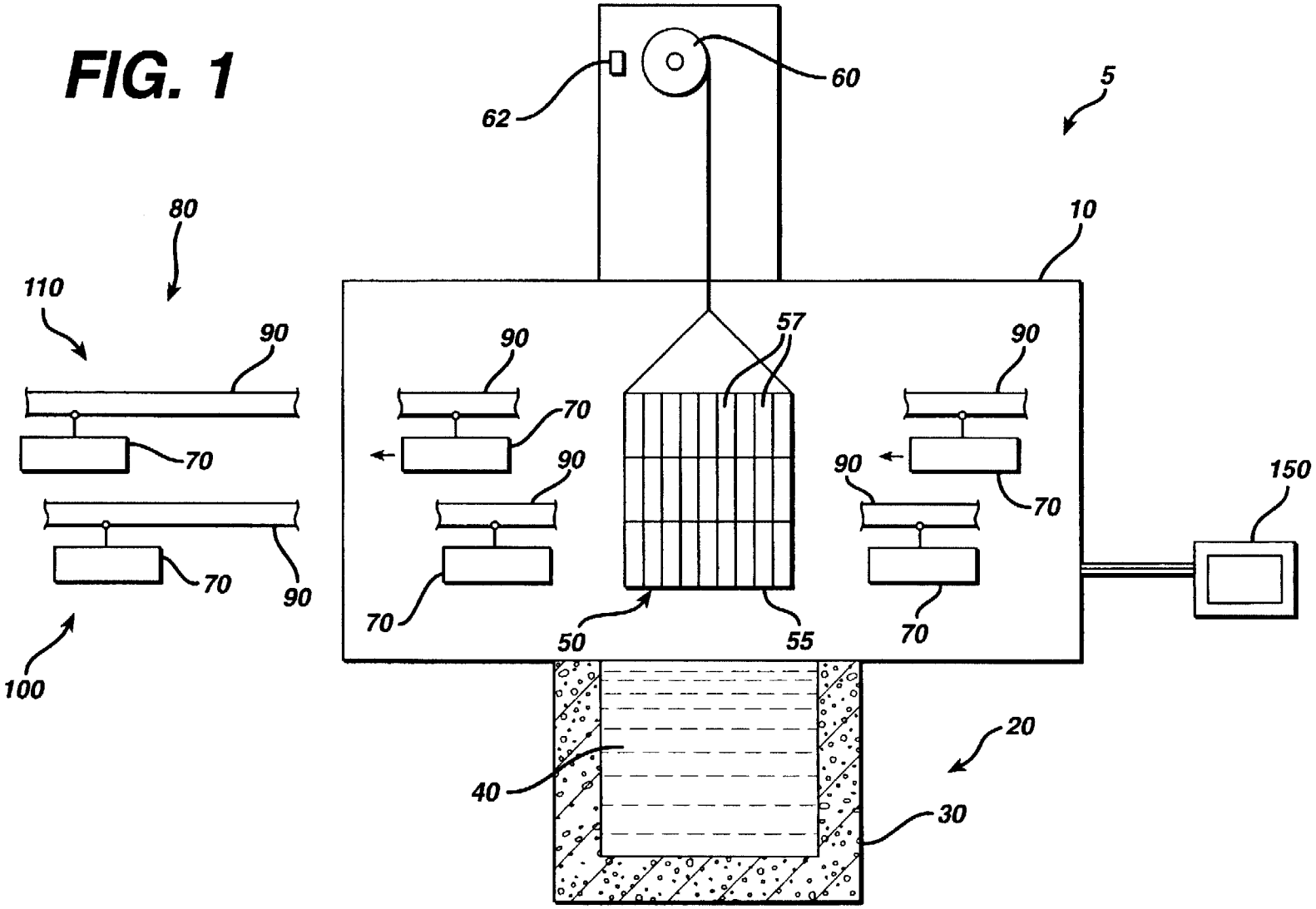
FIG. 1 is a schematic diagram of a $Co_{60}$ radiation sterilizer useful in the practice of the present invention.

A schematic of a conventional $CO_{60}$ sterilization unit 5 useful in the process of the present invention in seen in FIG. 1. The sterilization unit 5 is seen to have a containment structure 10. Containment structure 10 may be any conventional containment structure made of conventional radiation containment materials to effectively prevent transmission of substantially all of the radiation from source 50 to the exterior of structure 10, e.g., concrete, earth, lead, water, etc., and combinations thereof. At the bottom of containment structure 10 is the containment pool 20. Pool 20 is seen to have concrete pool structure 30 and containment bath 40. Pool 20 is sufficiently deep and wide to effectively contain containment bath 40 and prevent transmission of harmful levels of radiation. Containment bath 40 is preferably constituted of de-ionized water. Mounted to the top of structure 20 is the source elevator 60. Source elevator 60 raises and lowers the source 50 to the irradiation position and into the containment pool 20, respectively. Source elevator 60 utilizes conventional mechanisms to raise and lower the source such as cable, pulleys, air cylinders, hoists, etc., and the like. The source 50 is seen to consist of a conventional rack 55 containing pencils 57 of Co60. As mentioned above, rack 55 is moved between a first submerged storage position in bath 40 in pool 20 and a second exposed, irradiation position in structure 10. Elevator 60 has irradiation position sensor switch 62. Mounted in structure 10 is a conventional conveyor 80 having a conventional track 90 and a plurality of moveable conventional carriers 70 mounted to track 90. The track 90 is mounted about the source to form a loop. Track 90 of elevator 80 is seen to extend out of and exit the structure 20 on one end to accommodate an unloading station 110. Track 90 also extends into structure 20 to accommodate a loading station 100. Track 90 is seen to form a loop.

The sterilization cycle is controlled by a conventional central control console unit 150 having a conventional programmable logic controller computer configured to control the process. Central control unit 150 has conventional timers which control the process by controlling parameters such as dose rate and conveyor speed. Central control unit 150 also raises and lowers rack 55 in response to various criteria, including untoward movement of the source from the irradiation position.

Figure 2:
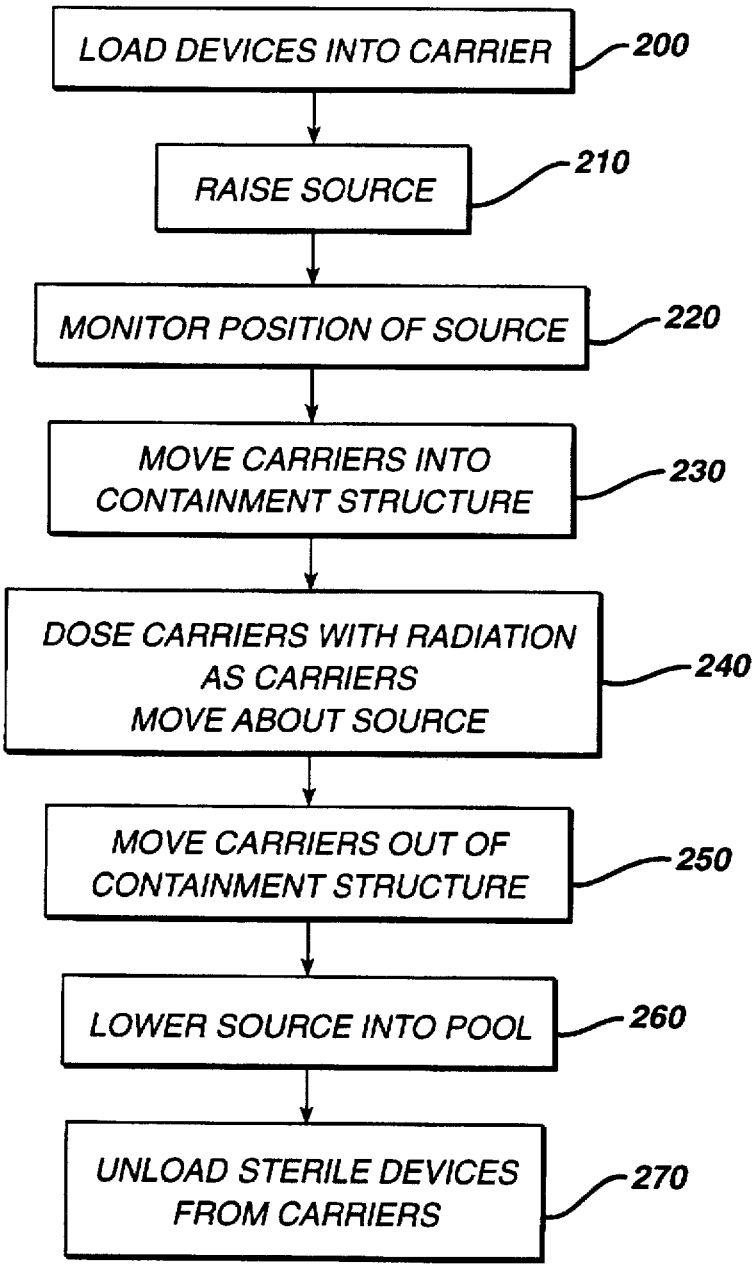
FIG. 2 is a flow diagram of a sterilization process of the prior art.

A process flow diagram for a conventional batch cobalt sterilization cycle is seen in FIG. 2. In step 200, medical devices 105 are loaded into carriers 70 at loading station 100. Then, in step 210, the source 50 is raised to the irradiation position from pool 20. In step 220, the position of the source is monitored throughout the cycle. Next, in step 230 the conveyor 80 moves the carriers 70 containing devices 105 into containment structure 10 along track 90. In step 240, the carriers are moved about source 50 along a pathway defined by track 90 at a sufficient index speed to obtain an effective radiation dose. The speed is controlled to produce the required dose to the medical devices 105. Then, in step 250 the carriers exit structure 10 on track 90 and are moved to unloading station 110 where the sterilized medical devices are removed from carriers 70 in step 270. When all of the carriers 70 are transported out of the containment unit 10, the cycle is complete and source 50 is lowered into pool 20 in step 260, or new product is loaded into the carries with the source up in a continuous flow of product. During this sterilization cycle, central control unit 150 will constantly monitor the cycle and the various parameters which control dosage.

Figure 3:
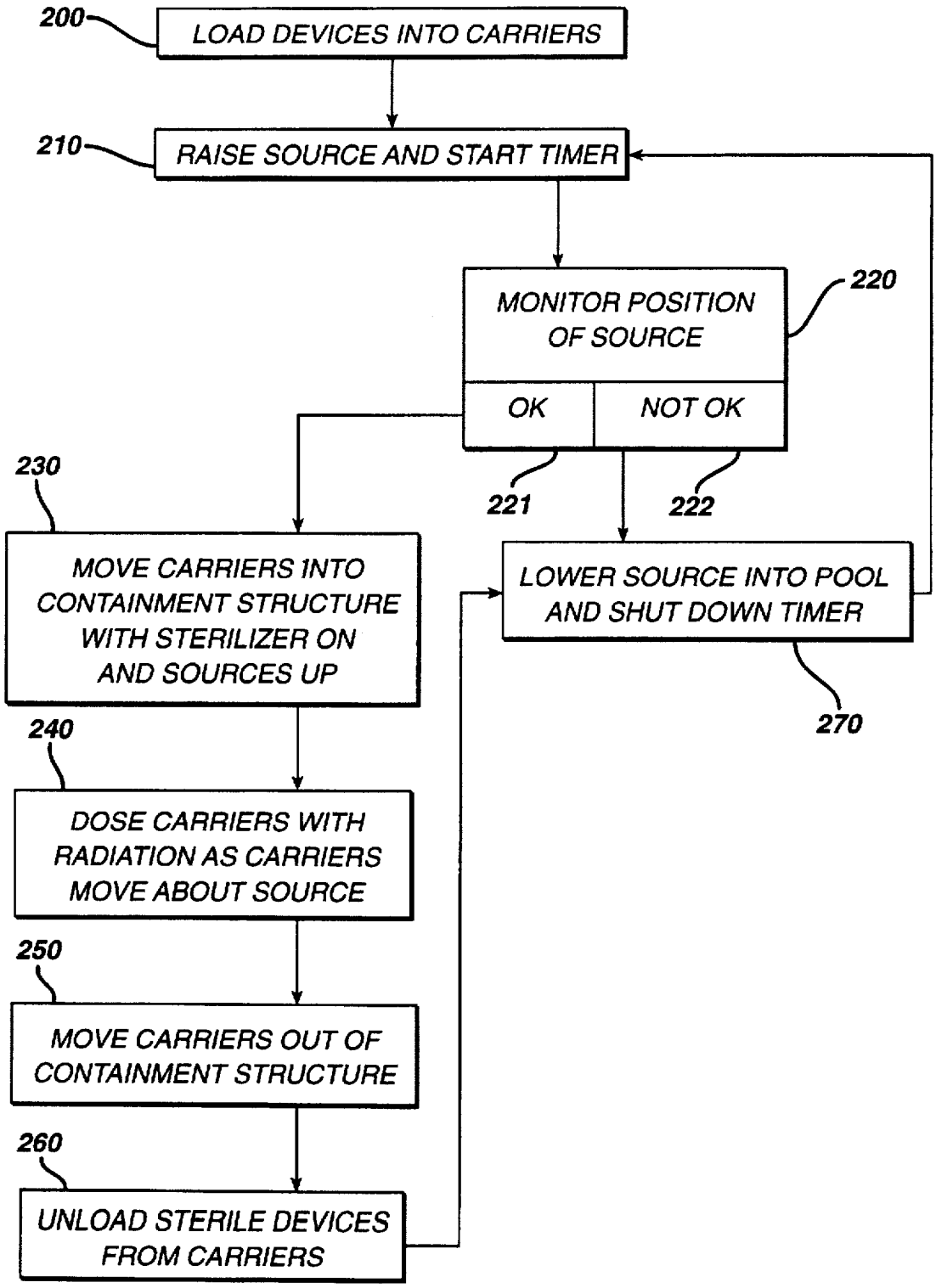
FIG. 3 is a flow diagram of the sterilization process of the present invention.

An improved process of the present invention is illustrated in the flow diagram is FIG. 3. In this improved process, the position of the irradiation source 50 is constantly monitored by monitoring the position sensing switch 62 via a programmable logic controller. New logic step 222 determines if the source 50 moves, or is moved, from the irradiation position untowardly, and, if movement is detected, directs the timer to shut down while simultaneously ordering that the source 50 be immediately lowered into the containment bath 40 (step 270). If the source is not moved, step 221 directs the process to move to step 230 wherein carriers containing devices 105 are moved into the containment structure. The source 50 is automatically raised to the irradiation position when the cycle is restarted and the cycle timer is re-started at the next startup (step 210). This improved method prevents over- or under-dosage of product in the sterilization unit 5 when experiencing a common situation wherein the source is out of the irradiation position but not in the containment bath, and the timer is stopped. Prior to the use of this improved process, there has been no way to prevent over- or under-dosage when experiencing this type of condition.

Figure 4:
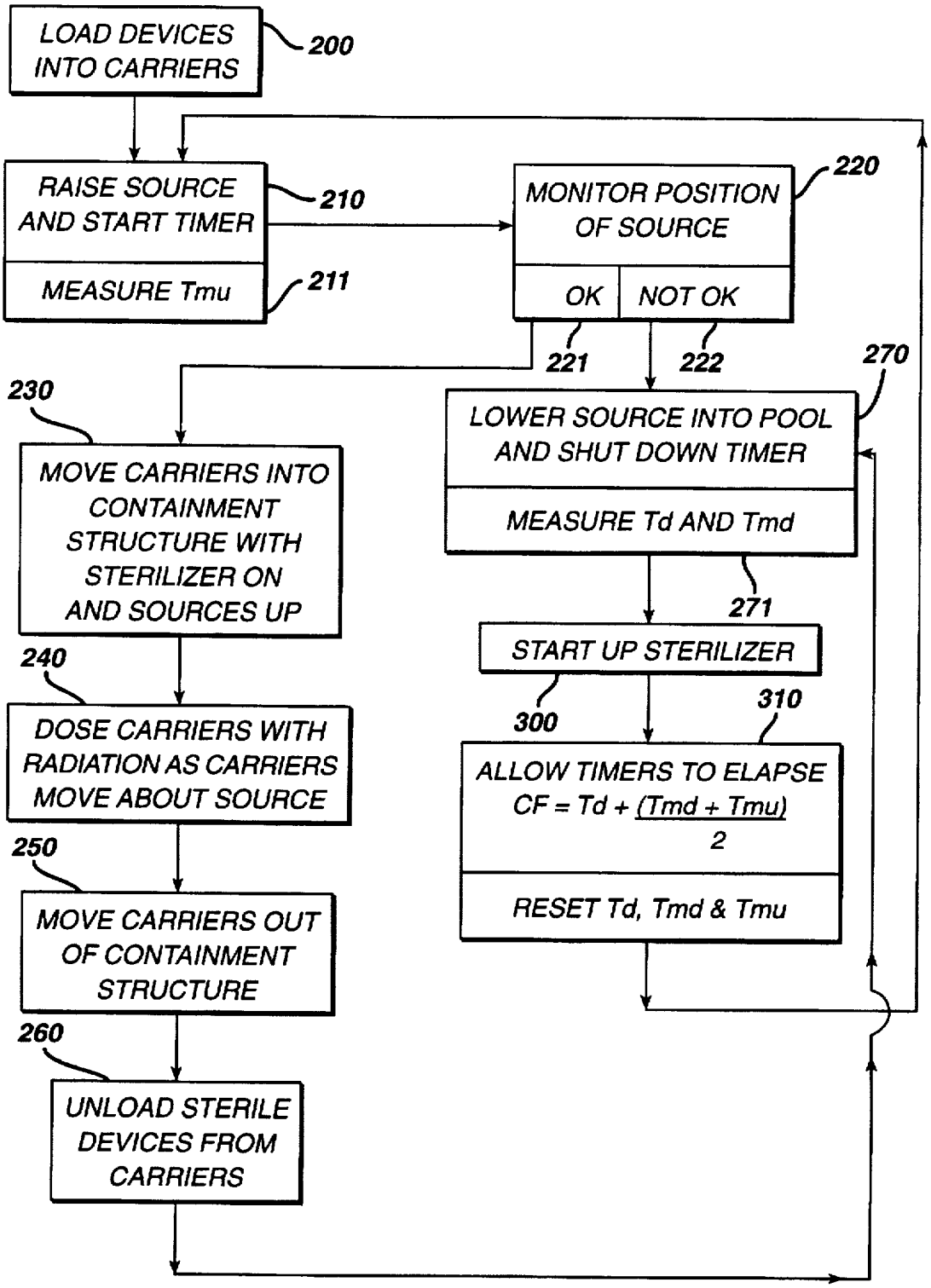
FIG. 4 is a flow diagram of an alternate embodiment of the sterilization process of the present invention wherein the cycle time is adjusted using an algorithm.

Another improved process of the present invention is seen in FIG. 4. This process contains additional process steps 211, 300 and 310. Process steps 211, 300 and 310 are logic steps such that if the source 50 is lowered and raised during a sterilization cycle as the result of untoward movement of the source from the irradiation position to a raised position different then the irradiation position in accordance with steps 222, 270 and 210, then the cycle time is recalculated by the programmable logic controller to provide for proper dosing. This prevents underdosing or overdosing of devices 105 while the source 50 is being raised or lowered. The logic controller uses the following algorithm when calculating the correction to the cycle time:

$$\text{Correction Value}=Td+(Tmd+Tmu)/2,$$

wherein Td is the time the source remains in a second raised position different from the irradiation position after movement from the irradiation position is detected;

Tmd is the time measured by the timers, after downward movement of the source has been initiated, for the top of the source to travel down from the raised position to the top of the containment pool; and, Tmu is the time for the top of the source to travel up to the irradiation position.

The correction value is subtracted from the timers for the correction factor period before the source is moved up from the bottom of the containment pool. The correction factor is subtracted from the cycle time by allowing the timers to elapse while the sterilizer has been successfully turned on, but the source is still stored in the containment pool. At the end of the elapsed correction factor time, the timers stop, all values Td, Tmu and Tmd are reset to zero, and the source is raised from the containment pool to the irradiate position and a new value of Tmu is measured and stored. Referring to FIG. 4, if the source position monitoring step detects no untoward movement, the process controller via step 221 proceeds to step 230 wherein carriers containing devices 105 are moved into the containment structure. If movement is detected, the logic controller proceeds to step 222 wherein the control unit proceeds to step 270 directing that the source be lowered into the containment pool and step 271 is initiated wherein the values Td and Tmd are measured. While in the pool the timers are allowed to elapse by the value of the Correction Value. Then the process proceeds to step 300 wherein the sterilizer is started up. Next, in step 310 the Correction factor is calculated by the programmable logic controller and the timers are allowed to elapse. Next the source is raised in step 210 and a new value of Tmu is measured and stored.

It will be appreciated by those skilled in the art that the processes of the present invention can be used not only for untoward or inadvertent source movement, but to correct cycle times for any occurrence resulting in a shut down. In addition, it will be appreciated that other algorithms may be used to correct cycle time.

The following example is illustrative of the principles and practice of the present invention.

EXAMPLE 1

Surgical needles are loaded into carriers of a JS-8900 Unit Carrier, Carrier Irradiator, manufactured by Nordion International, Inc., of Ontario, Can. The irradiator utilizes $CO_{60}$ pellets loaded into a source rack. The needles are moved through an irradiation room after the source rack has been moved out of the containment pool to a fixed irradiation position. A conventional central control unit, having conventional cycle timers and a conventional programmable logic controller, monitors the cycle and the position of the source in the irradiation position. The cycle is programmed for 1.5 minutes. The central control unit detects that the source has moved from the irradiation position and shuts down the cycle, and halts the cycle timers, and moves the source from the irradiation position into the containment pool. At the next startup, the source is then raised by the central control unit to the irradiation position. The cycle timers are then restarted and the sterilization cycle is completed. The needles are then transported out of the irradiation room having received a sufficient dose of radiation to effectively sterilize the devices, but not an excessive dose. The sterile devices are then moved to an unloading station and the cycle is terminated by lowering the source into the containment tank.

EXAMPLE 2

Surgical needles are loaded into carriers of a JS-8900 Unit Carrier, Carrier Irradiator, manufactured by Nordion International, Inc., of Ontario, Can. The irradiator utilized $CO_{60}$ pellets loaded into a source rack. The needles are moved through an irradiation room after the source rack has been moved out of the containment pool to a fixed irradiation position and a value of Tmu has been measured and stored. A conventional central control unit having a conventional programmable logic controller monitors the cycle and the position of the source in the irradiation position. The cycle is programmed for 20 minutes. During the cycle, the central control unit detects that the source has inadvertently moved from the irradiation position to a second raised position, and a programmable logic controller shuts down the cycle by ordering the elevator to move the source from the irradiation position into the containment pool, and, simultaneously stops the timers. During the shutdown sequence, the programmable logic controller measures the pause time between the untoward movement from the irradiation position to the second position, and the downward travel time for the top of the source to reach the top of the containment pool after the controller has initiated the downward movement. The controller also measures the pause time that the source remains in place prior to moving down. The programmable logic controller also measures the upward travel time for the top of the source to reach the irradiation position from the previous startup of the machine. The programmable logic controller then corrects the cycle time using a correction factor calculated using the following algorithm:

Correction Value=$Td+(Tmd+Tmu)/2$.

The cycle time is corrected by allowing the timers to elapse by an amount equal to the correction value. At the startup, the programmable logic controller then orders the elevator to raise the source to the irradiation position and restarts the timers and a new value of Tmu is measured and stored. Then the cycle is then completed using the corrected cycle time. The devices are then transported out of the irradiation room having received a sufficient dose of radiation to effectively sterilize the devices. The sterile devices are then moved to an unloading station and the cycle is terminated by lowering the source into the containment tank.

The improved process of the present invention has many advantages over conventional radiation sterilization processes. It is now possible to precisely account for the dosage of radiation received by a product when a source is lowered and then raised during a cycle. This input is used to recalculate the duration of the cycle to assure proper dosage. In the past, when untoward events occurred during a cycle, it was often necessary to discard the medical devices since proper dosage could not be determined or overdosage occurred. Resterilization is often not an alternative due to the cumulative effects of radiation.

Although this invention has been shown and described with respect to detailed embodiments thereof, it will understood by those skilled in the art that various changes in form and detail thereof may be made without departing from the spirit and scope of the claimed invention.

I claim:

1. Method of sterilizing a medical device by exposing the medical device to a $CO_{60}$ source for a sufficient amount of time to effectively sterilize the medical device during a sterilization cycle, wherein a $CO_{60}$ source is raised from a containment tank to an irradiation position and medical devices are transported past the source and the cycle timers time the cycle, the improvement comprising:

monitoring the position of the source during the cycle; and lowering the source down into the containment tank if the source moves out of the irradiation position and simultaneously stopping the cycle timers; and, raising the source upward out of the containment tank into the irradiation position; and, restarting the cycle timers.

2. A method of sterilizing a medical device by exposing the medical device to a $CO_{60}$ source for a sufficient amount of time to effectively sterilize the medical device during a sterilization cycle, wherein a $CO_{60}$ source is raised from a containment tank to an irradiation position and medical devices are transported past the source and cycle timers time the source, the improvement comprising:

measuring the time for the source to move from the containment tank to the irradiation position;

monitoring the position of the source during the cycle;

lowering the source into the containment tank if the source moves out of the irradiation position and simultaneously stopping the cycle timers;

measuring the pause time of the source and the time of the movement of the source into the containment pool;

correcting the cycle time sufficiently to provide an effective dose of radiation by using the following algorithm to calculate a correction factor:

Correction Value=$Td(Tmd+Tmu)/2$;

wherein Td equals the measured pause time between detection of movement out of the irradiation position into a second position and the start of movement down form the second position into the containment pool;

Tmd equals the travel time of the source from the second position down into the containment pool to be completely submerged;

Tmu equals the travel time of the source up to the irradiation position from the containment pool;

allowing the timers to elapse the time equal to the correction value; and, raising the source out of the containment tank into the irradiation position and again starting the cycle timers and measuring and storing a new value of the time for the source to travel from the containment tank to the irradiation position.

3. A method of sterilizing a medical device by exposing the medical device to a $CO_{60}$ source for a sufficient amount of time to effectively sterilize the medical device during a sterilization cycle, wherein a $CO_{60}$ source is raised from a containment tank to an irradiation position and medical devices are transported past the source and cycle timers time the source, the improvement comprising:

measuring the time for the source to move from the containment tank to the irradiation position;

monitoring the position of the source during the cycle;

lowering the source into the containment tank if the source moves out of the irradiation position and simultaneously stopping the cycle timers;

measuring the pause time of the source and the time of the movement of the source into the containment pool;

correcting the cycle time sufficiently to provide an effective dose of radiation by using an algorithm to calculate a correction value based upon the measured times;

allowing the timers to elapse the time equal to the correction value; and, raising the source out of the containment tank into the irradiation position and again starting the cycle timers and measuring and storing a new value of the time for the source to travel from the containment tank to the irradiation position.

* * * * *